United States Patent [19]

Elliott, Jr.

[11] Patent Number: 4,640,177

[45] Date of Patent: Feb. 3, 1987

[54] DRUMSTICKS OR MALLETS WITH PARA-HEMISPHEROIDAL HEADS AND THEIR ASSEMBLY

[76] Inventor: Francis J. J. Elliott, Jr., Band, OPS Co., H&S BN, MCDEC, Quantico, Va. 22134

[21] Appl. No.: 665,139

[22] Filed: Oct. 26, 1984

[51] Int. Cl.[4] ..... G10D 13/02

[52] U.S. Cl. ..... 84/422 S

[58] Field of Search ..... 84/422 S

[56] References Cited

U.S. PATENT DOCUMENTS

| | | | |
|---|---|---|---|
| 1,892,416 | 12/1932 | Vitto | 84/422 S |
| 1,953,619 | 4/1934 | Ludwig | 84/422 S |
| 2,466,554 | 4/1949 | Mossey | 84/422 S |
| 2,568,163 | 2/1952 | Heiderich et al. | 84/422 S |
| 3,151,518 | 10/1964 | Zarcone et al. | 84/422 S |
| 3,301,119 | 1/1967 | Gilbert | 84/422 S |
| 4,023,461 | 5/1977 | Brandolino | 84/422 S |
| 4,386,549 | 6/1983 | Shinneman | 84/422 S |

*Primary Examiner*—Lawrence R. Franklin

*Attorney, Agent, or Firm*—Shoemaker and Mattare, Ltd.

[57] ABSTRACT

In order to produce different tones and sounds from percussion instruments such as drums and the like, various configurations of heads of drumsticks or mallets are needed. Various shapes and sizes of heads are shown and described, varying from mushroom-shaped, thick crescent-shaped, thin crescent-shaped, paraboloid-shaped, hyperboloid-shaped, witchoid-shaped, cissoid-shaped, hemispheroid-shaped and conoid-shaped. Concave- and convex-outward configurations of these shapes are also depicted. Depending upon the mounting and shape of the heads, various desired sounds can be produced.

12 Claims, 34 Drawing Figures

DRUMSTICKS OR MALLETS WITH PARA-HEMISPHEROIDAL HEADS AND THEIR ASSEMBLY

BACKGROUND OF THE INVENTION

1. Field of the Invention

This invention relates to drumsticks and mallets, and especially to those having heads of different sizes and shapes for producing different musical responses from various types of drums and/or other types of percussion instruments.

2. Description of the Prior Art

A common problem with drumsticks and mallets of conventional types is that they generally are of a rather conventional style with regard to head size and shape, and offer limited utility and little variety to percussionists.

There have been various types of drumsticks and mallets produced; however, the ones known to the present inventor leave much to be desired, especially in the areas of tone production and rebound.

Drumsticks and mallets have been the subjects of several patents, often relating to features specific to the handle or shaft portions thereof. It is common for conventional drumsticks and mallets to be provided in a variety of models varying in size, weight, hardness, and so forth. However, the instrument-contacting portions have received little attention towards improvement by way of invention, especially in the areas of tone production and rebound.

To wit, terms such as "ball", "bead", and "tip" refer to the roughly globular structure of the instrument-contacting portions of drumsticks and mallets of conventional design. The present invention discloses a number of embodiments of specially shaped instrument-contacting portions (herein referred to as "heads"), of which an important feature is that in use the heads produce a crescent-shaped imprint upon the playing surface, thereby enhancing desirable tone production and rebound.

Also, it is highly desirable that a percussionist, for reasons of economy and portability (or, having become familiar or accustomed to a particular pair or set of drumstick or mallet handles), be provided with structure that enables him or her to change or modify the head portion (s) of each stick or mallet as desired, easily and rapidly.

SUMMARY OF THE INVENTION

An object of the present invention is to provide a stick or mallet with a para-hemispheroidal (mushroom-shaped) head (or two heads, in the case of the double-headed embodiments) which can be used, in either a concave-outward or convex-outward configuration, depending on the choice of the percussionist, to ameliorate tone production and rebound, by virtue of the effects upon contact with the playing surface thereby obtained. Further modifications embody paraboloid, hyperboloid, witchoid, cissoid, hemispheroid, and conoid types of heads. Also, slightly more conventional crescent-shaped and truncated hemispheroidal heads are provided. In end elevation, the various configurations may be provided in circular, oval, semi-oval, elliptical, triangular, rectangular, or square form, and various combinations of these shapes and configurations or modifications thereof, as noted below.

Another object of the present invention is to provide a stick or mallet having a head which can be of different sizes, shapes, densities, weights, and playing-edge softnesses; and preferably further, changeable from one size, shape, density, etc. head type to another using the same basic stick or handle.

Another object of the present invention is to provide easily installed, easily changeable heads for mounting upon the same or other stick or mallet handles. Various structures for ease of changeability and yet secure attachment are provided for.

The present invention has a number of new and novel features. Among them are changeable heads of various sizes and shapes, several modifications of basic stick and mallet handles, and various attachment and securement structures which permit quick, easy replacement and change of the various head embodiments. In cross-section, the changeable heads can vary between para-hemispheroidal embodiments such as truncated thick or thin crescent-shaped, and thick or thin semi-circular, parabolical, hyperbolical, witchical, cissoidal, and conal. Also, as viewed in end elevation, various shapes can be employed, from completely circular to oval or semi-oval, triangular, or square, in either a centered-mounting or offset-center (here center referring to the origin or focus of the given shape) mounting configuration.

This selection and variability of different head types, sizes, shapes and so on offers percussionists a more complete range of application for sticks and mallets, with increased applicability to the peculiarities of membranophones, cymbals, and mallet instruments, for enhanced tone production and rebound.

These together with other objects and advantages which shall become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4A is a partially cross-sectional detail view of a concave-outward thick crescent-shaped head and mounting embodiment, while

FIG. 5A is a partially cross-sectional detail view of a concave-outward thick crescent-shaped head, showing another attachment structure, while FIGS. 5A–5B, and 5C depict different drumstick embodiments with FIG. 5C showing the head portion formed integrally with the stick handle. Obviously, as only one end of the stick is pictured, the other end could have a head formed or attached likewise thereto, to facilitate playing with either or both ends as desired.

FIG. 8A depicts a paraboloid shape, partly in cross-section; FIG. 8B a hyperboloid; 8C a witchoid, partly in cross-section; FIG. 8D a cissoid, partly in cross-section; FIG. 8E a hemispheroid, and FIG. 8F a conoid. FIGS. 8C and 8D are depicted in off-center embodiments, although they could be regular concentric geometric forms instead.

FIG. 9B shows in side elevation the contact portions of these two versions with the drumhead, while

FIG. 10A shows a conventional drumstick of a typical prior art design while

DESCRIPTION OF THE PREFERRED EMBODIMENTS

Figure 1:
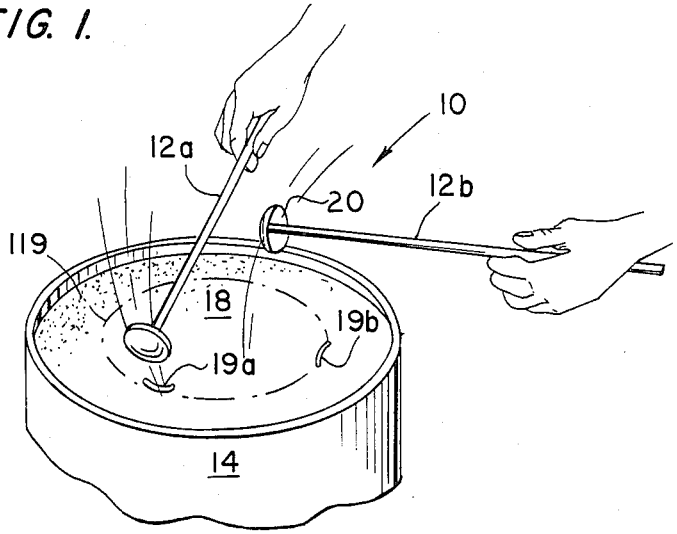
FIG. 1 is a perspective view of para-hemispheroidal headed sticks as in use with a conventional drum-type percussion instrument.

Referring to FIG. 1 of the drawings, reference numeral 10 indicates in general the present invention as in use. A pair of sticks 12*a,b* are being used with a drum 14, upon which a drumhead 18 is mounted. The drumhead 18 is being struck by the drumstick heads 20 on contact areas 19*a* and 19*b*; contact area 19*a*, a thin crescent-shaped form, results from a relatively low-pressure stroke, whereas contact area 19*b*, a thick crescent-shaped form, results from a relatively high-pressure stroke. The orientation of each stick is important, and bears upon the tone quality and stick rebound characteristics. The stick 12*a* producing the imprint at area 19*a* is positioned on an axis nearly perpendicular to a line horizontally tangent to the perimeter of drumhead 19, and produces a curved impression (imprint) of a crescent shape, as does the stick 12*b* producing the imprint at area 19*b*, although the latter stick is positioned nearly at right angles with respect to the former.

In actual practice, of course, the imprints are invisible, but are shown here to explain a very important advantage of the present invention; that is, the improved tone quality and rebound characteristics to be realized upon using this invention, especially when the semi-circular (crescent-shaped) imprints produced are oriented like those of contact area 19*a*.

The broken lines 119 of FIG. 1 indicate an imaginary circle on the drumhead which is concentric thereto. It can be seen by one skilled in the art that the accomplishment of the object of setting the drumhead 18 in an oscillating motion (or simply setting it in motion, in case it is dampened or muffled, and thereby prevented from oscillating) either by intermittent strokes or a rapid, evenly timed succession of strokes (commonly referred to as a "roll") shall be brought about more easily due to the advantages of the present invention. In actual use, the heads 20 tend to play more easily (requiring less effort) when their imprints form arcs along such an imaginary circle concentric to the drumhead 18.

Another advantage of the present invention is that the desirable features of enhanced tone production and more effortless rebound may be enjoyed, using the correct head configuration (either concave-outward—that is, the concave surface of the stick or mallet head faces away from the hand manipulating the handle— or convex-outward), on the area of the drumhead 18 between its edge and center, either nearer to or farther from the percussionist. However, when playing across the drum (on the farther-from-the-player portion of drumhead 18), idealized stick positioning while rolling is impossible, and so a compromise position with the sticks nearly parallel and close together is suggested.

Of course, when the heads 20 are used to produce an imprint more like that of area 19*b* (in orientation), or if they are used in differing positions, as they are in FIG. 1, a further advantage of the present invention is that discernably differing timbres are obtained thereby, without the inconvenience of using more than one stick or mallet type at a time, while continuing to enjoy the benefit of improved stick rebound ("feel").

The question of how drumsticks of the present invention perform in use at the center of a drumhead compared with sticks of conventional design is valid; however, in most cases, strokes contacting the center of a drumhead could be described as non-resonant (or "dry"), and although the imprints produced by embodiments of this invention do not imitate the circular area of a drumhead center, increased resonance at that point is not anticipated (or, in fact, necessarily desirable) anyway, and again, improved rebound could serve to delay the onset of muscle fatigue, whether it improves the timbre of strokes at the center of drumhead 18 noticeably or not.

Further, it should be clear, upon consideration of the subsequent explanation, how the improved shape of the heads 20 is more applicable to the percussion family of instruments in general, especially (in addition to drums of all types) cymbals (upon which rebound and timbre bear critically), for example, at or near the steeply inclined bell or cup area, where the present invention may be used to substantial audibly improved effect,and mallet instruments (upon which, again, timbre and rebound bear critically, although timbre perhaps more so).

Figure 2A:
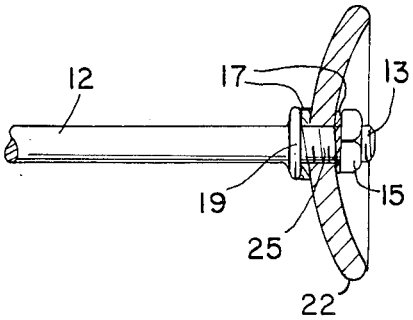
FIG. 2A is a partially cross-sectional detail view of the concave-outward embodiment of the invention of FIG. 1, showing an embodiment of structure whereby the head is removably attached.
Figure 2B:
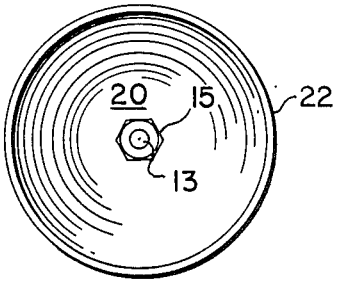
FIG. 2B is an end elevation of the FIG. 2A embodiment.

The preferred embodiment of the present invention is depicted in FIGS. 2A and 2B and is a concave-outward para-hemispheroidal (mushroom-shaped) head 20 affixed to the end of stick 12, as shown. The outer circumferential edge 22 of the head 20 is rounded, and, because of the shape of the head 20 itself, will strike the drumhead surface 18 somewhat at an angle. In this embodiment, the head 20 is affixed by a screw and nut structure consisting of connector portion 25 with threads 13 and a nut 15 thereon. Washers 17 are mounted on either side of head 20 between nut 15 and flange 19.

FIG. 2B shows the circular configuration of this preferred embodiment; however, as shown in further views, other, non-circular shapes can be employed if desired. It should be noted that in each embodiment of the present invention, the stick or mallet heads have a common feature, which is, that each has an inward and an outward end, one being concave, the other convex. As elaborated above, a given stick or mallet configuration is either convex inward/concave outward or vice versa, and finds application according to the discretion of the percussionist in whatever configuration he or she finds most suitable for the given instrument(s) and situation(s).

Figure 3A:
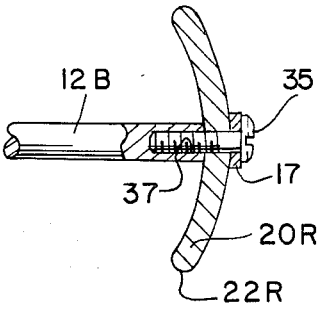
FIG. 3A is like FIG. 2A, except it depicts a convex-outward embodiment of the invention, and other structure by which the head is detachably mounted is shown.
Figure 3B:
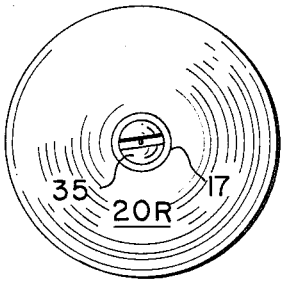
FIG. 3B is an end elevation of the embodiment of FIG. 3A.

FIGS. 3A and 3B show the same shaped head 20 as already described; however, in this embodiment the head 20R is reversed, being therefore convex-outward. Also, the head is mounted using a screw 35 threaded into the aperture 37 in the end of stick **12*b*. A washer 17** is mounted between the screw head and the head itself.

Mention is made here that because the heads 20, 20R in these embodiments are removable, the simple addition of more washers 17 can solve the problem of the heads becoming too compressed by their mountings with age and so loose.

Figure 4A:
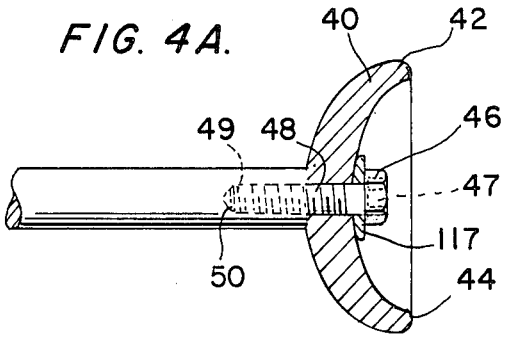
Figure 4B:
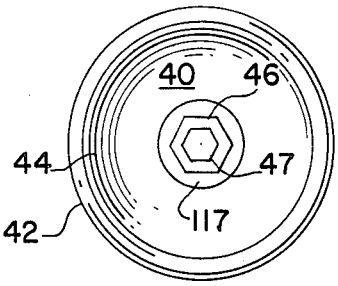
FIG. 4B shows it in end elevation.

FIGS. 4A and 4B depict a thick crescent-shaped embodiment 40 having a circumferential edge 42 therearound, and an edge face surface 44. Obviously, any of the head shapes depicted could be furnished with reinforcement means in the form of washers or rings or pressurized cavities, insofar as the inventive concept here requires the stick or mallet heads to be resilient, yet in some cases soft as well. In FIG. 4A, the stick needs no flange.

In FIGS. 4A and 4B, a hex or spline screw 46 having external threads 48 is screwed into aperture 50, which may or may not be furnished with internal threads 49, depending upon the materials used to construct the assembly. The washer 117 has a curved surface for contact with the head 40, and the screw 46 has an Allen wrench socket 47 therein. The various attachment structures shown in the drawings may be considered somewhat optional; in other words, they are shown to indicate a variety of possibilities, not only one method, to attach head 40 to handle 112.

Figure 5A:
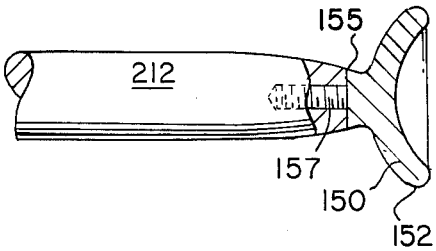
Figure 5B:
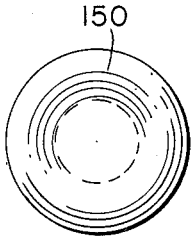
FIG. 5B is an end elevation of this embodiment.
Figure 5C:
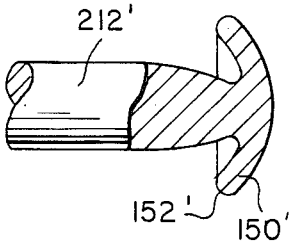

FIGS. 5A and 5B show an embodiment wherein the para-hemispheroidal head portion 150 having a circumferential edge 152, may be either attached to (using any of various removable or permanent methods, such as screw threads, pinned dowel, adhesives, etc.) or formed integrally with stick handle 212. In double-headed embodiments, of course, two heads are mounted or formed on the stick, of either different types (for versatility) or identical types (of heads); the drumstick type embodiments are well-suited for fabrication in double-headed models. In FIG. 5A, the line 155 represents where the head 150 attaches by screw projection 157 when made separately. FIG. 5C shows a convex-outward version 150' with edge 152' of FIG. 5A formed integrally with the drumstick 212'.

Figure 6B:
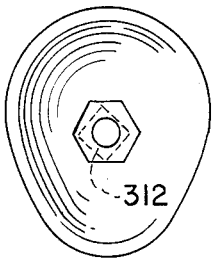
FIG. 6B shows in end elevation the tapered semi-oval shape of this embodiment; the broken lines indicate the alignment of the shape of the head as viewed on end with the shape of the beater rod, which is square.
Figure 6A:
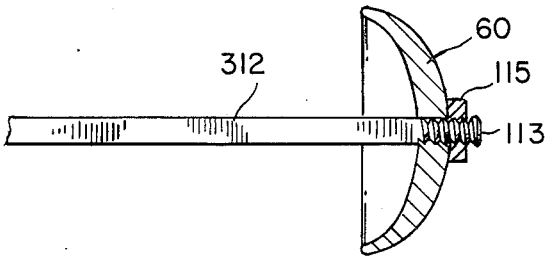
FIG. 6A is a partially cross-sectional detail view of a convex-outward thin crescent-shaped head, with structure for detachably attaching the head to the rod.

FIG. 6A shows a thin crescent-shaped head 60 connected to square rod 312, which is rounded where head 60 screws onto it; either or both the square rod 312 and the head 60 may be furnished with threads for this purpose, depending on the materials used and so forth. A locknut 115 may also be used for positive securement of the head to the stick. Again, different means, such as a quick-disconnect could be used to attach the head 60 to the rod 312. In end elevation, FIG. 6B shows the tapered semi-oval shape of this embodiment. The dotted lines indicate how the square rod 312 is aligned with respect to head 60. This embodiment is intended for use in a bass drum pedal which has means to enable the rod 312 to be indexed to the desired position, enabling a choice of playing surfaces on head 60.

Figure 7A:
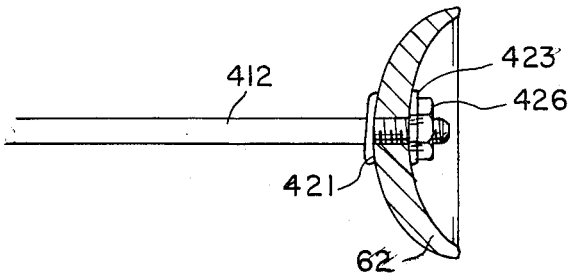
FIG. 7A is a partially cross-sectional detail view of a concave-outward thin crescent-shaped head, shown with attachment means securing it to a round beater rod.

FIG. 7A depicts a thin crescent-shaped head 62 which is positioned in the reverse of that of FIG. 6A. Head 62 is shown fixed between flange 421 and washers 423 by locknut 426, which screws onto the threaded end of round rod 412. This embodiment is intended for use in a conventional bass drum pedal, hence the round rod 412.

Figure 6C:
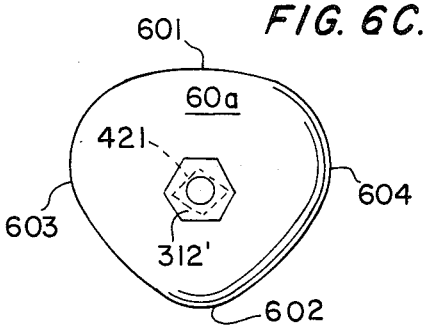
FIG. 6C shows in end elevation a different beater head profile which is approximately triangular; of course, the heads could be formed differently than the heads of either FIGS. 6A or 6C, as various shape combinations and variations as depicted in FIGS. 7B and 7C are possible.

FIG. 6C depicts an approximately triangular (three-sided) head **60*a*, which could be a profile of head 60 of FIG. 6A or head 62 of FIG. 7A. The broken lines indicate alignment of both a square and round rod; but it is noted that probably only the three semi-flat surfaces would be usable on a round rod due to the tendency of the head and/or rod to rotate in use. However, presuming the head is non-rotatably fixed on a square rod, the latter could be indexed in its mounting to afford use of a semi-flat face, a semi-pointed face, and faces with semipointed protrusions, which are indicated by reference numerals 601–604 respectively, opposing protrusions 603, 604** being off-center.

Figure 7B:
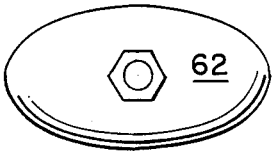
FIG. 7B shows the embodiment of FIG. 7A in end elevation, in an elliptical configuration.

FIG. 7B shows the elliptical shape of the head 62 in end elevation.

Figure 7C:
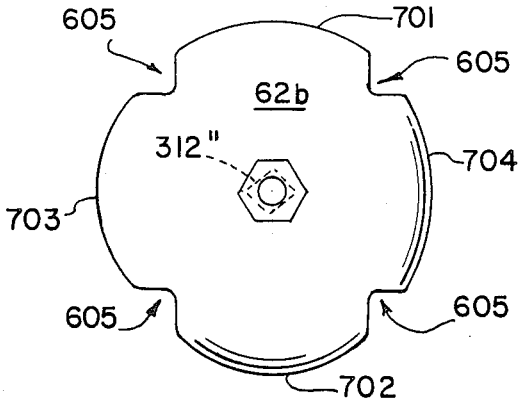
FIG. 7C shows a novel square configuration for a beater head in end elevation, with reliefs formed into the corners so that the various (multi-shape/softness) faces do not interfere with each other in use. Of course, in actual practice, either the square beater rod of FIG. 6A or the round type rod of FIG. 7A can be used with any of these heads.

FIG. 7C shows a square head configuration **62*b* which could be applied aptly to either a round or square rod due to the relative flatness of all four of its faces (playing surfaces). In practice, up to four different (as viewed from the sides-not pictured) shapes and/or playing-surface softness could be used (one at a time). Reliefs 605 prevent interference of the two adjacent faces with the one in use. Of course,the various end elevations could be used interchangeably and with other than the thin crescent-shaped side profile of heads 60 and 62**, e.g., see FIGS. 8A–8E below, to produce percusion beaters of varying geometries.

While the various heads described above have various types of connections depicted, e.g., locknut on threaded rod end, and mounting screw, or other types of affixing means, such as clamps, tapered wedges, epoxy glue, or other chemical affixing compositions or methods, e.g., shrink fitting or welding, can be used.

Figure 8A:
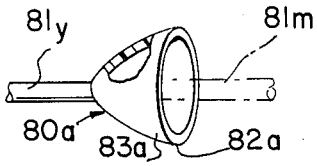
FIGS. 8A–8F show various other embodiments of the heads of the present invention.
Figure 8B:
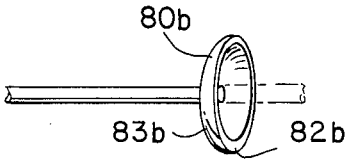
Figure 8C:
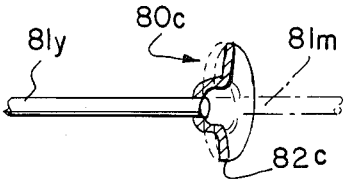
Figure 8D:
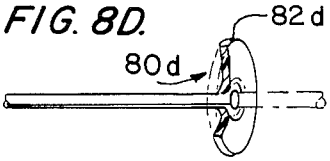

FIGS. 8A–8F depict other shapes of mallet heads of the present invention. FIG. 8A shows a paraboloid-shaped head **80*a*, a circumferential striking edge 82a, and a tapered, curved conical surface 83*a*. FIG. 8B shows a hyperboloid-shaped head 80*b*, edge 82*b*, and surface 83*b*. FIGS. 8C and 8D show witchoid- and cissoid-shaped heads 80*c* and 80*d*, respectively, with circumferential striking edges 82*c* and 82*d*** respectively. Parts of the heads of FIGS. 8A, 8C, and 8D are cut away to show details of their construction more clearly. The shapes of FIGS. 8C and 8D are extended more towards one portion of their circumferences, i.e., off center, to show a possible modification of a basic geometric mallet head embodiment on each head. Their thicknesses could be altered similarly, as could the thicknesses and/or circumferences of any of the other embodiments, if desired.

Another feature of the present invention is that a stick or handle 81*y* can be integrally formed or attached with these respectively shaped heads, and as initially fabricated, the stick 81*y* can extend longitudinally for the desired length on both sides of the head, shown in broken lines is the stick/handle extension 81*m* (see FIG. 8A). An advantage of this type construction is that the stick or mallet can be made, distributed, and sold with the portions 81*y* and 81*m* extending from both sides of the head itself, and then the user can determine in which manner he or she wishes to use the head and appropriately sever the stick/handle side not wanted.

Figure 8E:
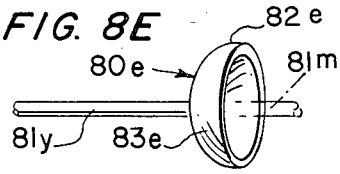
Figure 8F:
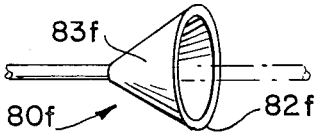

FIG. 8E depicts a hemispheroid-shaped head 80*e* with edge 82*e* and surface 83*e*, while FIG. 8F shows a conoid-shaped head 80*f*, edge 82*f*, and surface 83*f*.

Figure 9A:
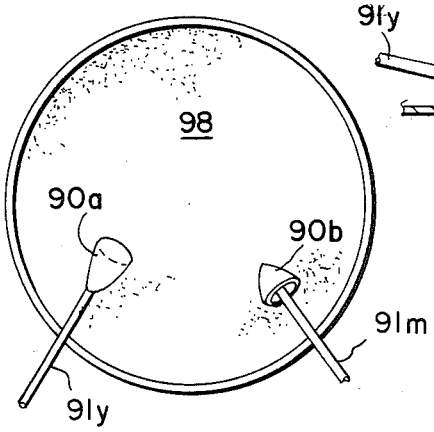
FIG. 9A shows the paraboloid embodiment, both concave-outward and convex-outward versions, positioned over a drumhead.
Figure 9B:
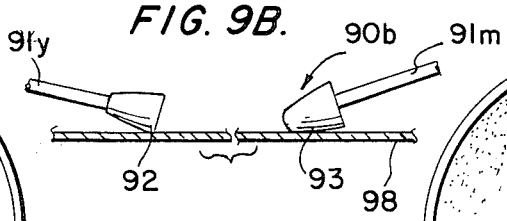
Figure 9C:
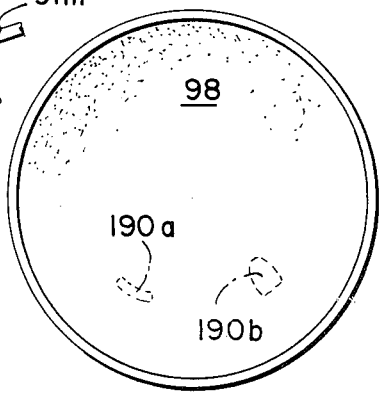
FIG. 9c shows the basic impression (imprint) made thereby.

FIGS. 9A, 9B, and 9C show both versions of the FIG. 8A embodiment, i.e., the paraboloid configured head, with one head 90*a* having the stick 91*y* extending from the apex of the head, while the other head 90*b* has the stick 91*m* extending from the larger end of the head. The side elevation of FIG. 9B shows how the circumferential edge 92 of the head 90*a* and the tapered surface 93 of the head 90*b* contact the drum-head 98. FIG. 9C shows prints 190*a*, 190*b* made by these heads which can be compared to prints 19*a*, 19*b* made by the mushroom-shaped truncated hemispheroid-shaped head of FIGS. 1, 2A and 3A.

Figure 10A:
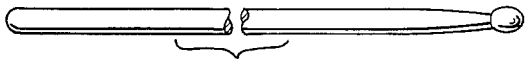
FIG. 10A. (PRIOR ART)
Figure 10B:
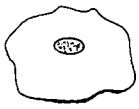
FIG. 10B. (PRIOR ART)
FIG. 10B shows the imprint of such a stick.

FIGS. 10A and 10B show a prior art conventional type drumstick and the imprint made thereby.

Figure 11A:
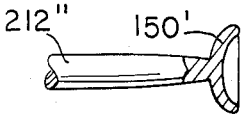
FIG. 11A shows a solid stick with a concave-outward crescent- (mushroom-) shaped head like FIGS. 3A and 4A.
Figure 11B:
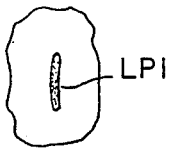
FIGS. 11B and 11C show the respective imprints made by the embodiment of FIG. 11A, when played upon the drumhead lightly and heavily, respectively.
Figure 11C:
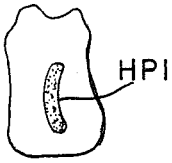
Figure 12A:
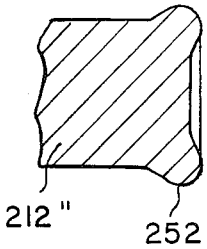
FIGS. 12A–12D show, in cross-section, various other drumstick head profiles of different configurations.
Figure 12B:
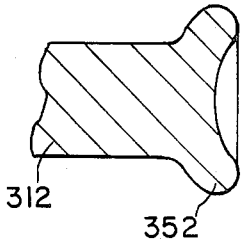
Figure 12C:
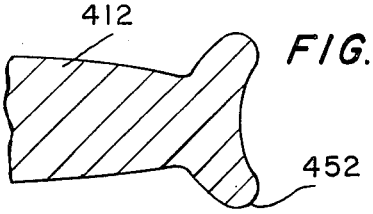
Figure 12D:
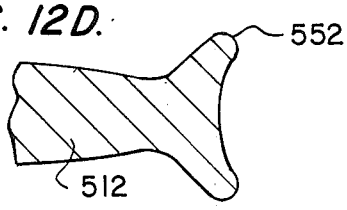

FIG. 11A shows a crescent-shaped head, like the embodiment of FIGS. 5A and 5B, which is integral with the drumstick. The length and diameter of the stick handle itself are similar to that of the prior art of FIG. 10A. FIGS. 11B and 11C show two typical imprints of the FIG. 11A embodiment, depicting in FIG. 11B a low-pressure imprint LPI, and in FIG. 11C a high-pressure imprint HPI.

FIGS. 12A–12D show various modifications of the FIG. 5A or 5C embodiment in cross-section. The various circumferential edges shown 252, 352, 452 and 552, vary for producing different stick handling and rebound characteristics ("feel")and different sounds from the drumhead.

Although as mentioned above, idealized stick positioning is impossible when rolling on the area of a drumhead between edge and center and away from the performer, using the convex-outward type stick (intended for this purpose) has the advantages of providing for a more comfortable arm position when playing a drum positioned very close in front of the drummer, e.g., a field drum carried on a sling and resting on the drummer's leg, and facilitating, due to hand position over or nearer to the drumhead, muffling of the drum quickly after playing it.

In practice, the angle of the central axis of stick/handle relative to the plane of the drumhead can have a decided influence on the timbre of the strokes, especially for head types with large head curve factors. This is considered a useful characteristic of the present invention, carefully applied, and lends itself to rapid timbral changes often required when performing expressive passages on mallet instruments, e.g., vibraphone. Another feature of the present invention, although perhaps obvious or previously anticipated, is that upon severing the stick or handle in an embodiment similar to that of FIGS. 8A–8F, as described above, a portion of the side not wanted for use as the handle could be left intact to form a sort of compound head with a small portion of the stick extending outwardly from the head, for special effects, such as playing a triangle or playing very softly ("sotto voce") without changing beaters.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A drumstick or mallet comprising:

an elongated handle;

at least one enlarged, para-hemispheroidal head means attachable to said handle for use in beating a percussion instrument; and means for detachably affixing in secure fashion said head means to said handle.

2. The drumstick or mallet of claim 1, with said head means attached in a concave-outward configuration.

3. The drumstick or mallet of claim 1, with said head means attached in a convex-outward configuration.

4. The drumstick or mallet of claim 1, wherein said elongated handle is relatively fat in circumference for most of the length thereof, tapering toward the head means thereof.

5. The drumstick or mallet of claim 1, wherein said elongated handle is very slim in proportion to its overall length, and the portion adjacent the head affixing end is of the same diameter as the rest of the handle.

6. The drumstick or mallet of claim 1, wherein said means for detachably affixing said head means in a secure fashion to said handle includes a screw type fastener.

7. The drumstick or mallet of claim 1, wherein said means for detachably affixing said head means in a secure fashion to said handle includes a quick-disconnect type of fastener.

8. A drumstick or maller comprising:

an elongated handle;

one enlarged, para-hemispheroidal head means for use in beating a percussion instrument;

means affixing said head in secure fashion to the midpoint of said handle so that one length or the other of the handle can be severed between its outward end and said head, near said head, and then removed so the drumstick or mallet can be used with the head in either a concave-outward or convex-outward configuration; and said head means being structured and configured so that a wide range of sounds can be effected thereby.

9. The drumstick or mallet of claim 1 or claim 8, wherein said para-hemispheroidal head means configuration is selected from the group of shapes consisting of mushroom, crescent, paraboloid, hyperboloid, witchoid, cissoid, hemispheroid, and conoid.

10. The drumstick or mallet of claim 1 or claim 8, wherein when viewed from the end, said head means is in a configuration selected from the group consisting of round, tapered or elongated oval or elliptical, triangular, preferably with rounded corners and slightly rounded faces, and square, preferably with slightly rounded faces and invert corners.

11. A drumstick comprising:

an elongated handle;

an enlarged head means attachable to one end of said handle for use in beating a drum;

means for detachably affixing in secure fashion said head portion to said handle; and said head means including a reverse mushroom-shaped structure.

12. A drumstick comprising:

an elongated handle;

an enlarged head means attachable to one end of said handle for use in beating a drum;

means for detachably affixing in secure fashion said head portion to said handle; and said head means including a mushroom-shaped structure.

* * * * *

UNITED STATES PATENT AND TRADEMARK OFFICE

CERTIFICATE OF CORRECTION

PATENT NO. : 4,640,177

DATED : Feb. 3, 1987

INVENTOR(S) : Francis J. J. Elliott, Jr.

It is certified that error appears in the above-identified patent and that said Letters Patent is hereby corrected as shown below:

On the Title Page, Item /76/

Address of the inventor should read as follows:

PerPro Incorporated
210 Westport Road
Kansas City, Mo. 64111

Signed and Sealed this

Twenty-first Day of April, 1987

*Attest:*

DONALD J. QUIGG

*Attesting Officer*

*Commissioner of Patents and Trademarks*